United States Patent [19]

Delwel et al.

[11] Patent Number: 4,637,891

[45] Date of Patent: Jan. 20, 1987

[54] PROCESS FOR THE MANUFACTURE OF DETERGENT COMPOSITIONS CONTAINING SODIUM ALUMINOSILICATE

[75] Inventors: Francois Delwel, Dordrecht; Marinus L. M. Claassens, Roosendaal, both of Netherlands

[73] Assignee: Lever Brothers Company, New York, N.Y.

[21] Appl. No.: 695,742

[22] Filed: Jan. 28, 1985

Related U.S. Application Data

[63] Continuation of Ser. No. 358,989, Mar. 17, 1982, abandoned.

[30] Foreign Application Priority Data

Mar. 20, 1981 [GB] United Kingdom ..... 8108807

[51] Int. Cl.[4] ..... C11D 17/06

[52] U.S. Cl. ..... 252/135; 252/140; 252/174; 252/174.19; 252/174.21; 252/527; 252/546

[58] Field of Search ..... 252/135, 140, 174, 174.19, 252/174.21, 174.25, 527, 546; 264/117; 23/313 R, 313 RS

[56] References Cited

U.S. PATENT DOCUMENTS

| | | | |
|---|---|---|---|
| B 305,417 | 1/1975 | Nirschl et al. | 252/131 |
| 3,838,072 | 9/1974 | Smith et al. | 252/540 |
| 3,888,781 | 6/1975 | Kingry et al. | 252/99 |
| 3,966,629 | 6/1976 | Dumbrell | 252/140 |
| 4,096,081 | 6/1978 | Phenicie et al. | 252/131 |
| 4,171,277 | 10/1979 | Dankworth et al. | 252/140 |
| 4,180,471 | 12/1979 | Schrodter et al. | 252/140 |
| 4,215,007 | 7/1980 | Krings et al. | 252/174.25 |
| 4,248,911 | 2/1981 | Wixon | 252/174.13 |
| 4,288,340 | 7/1981 | Dankworth et al. | 252/140 |
| 4,411,809 | 10/1983 | Wixon | 252/174 |
| 4,488,972 | 12/1984 | Weinstein | 252/174.25 |
| 4,526,702 | 7/1985 | Larr et al. | 252/174.25 |

FOREIGN PATENT DOCUMENTS

| | | |
|---|---|---|
| 10247 | 4/1980 | European Pat. Off. . |
| 21267A | 1/1981 | European Pat. Off. . |
| 2529685B | 6/1975 | Fed. Rep. of Germany . |
| 1473201 | 4/1974 | United Kingdom . |
| 1473202 | 4/1974 | United Kingdom . |
| 1533415 | 10/1975 | United Kingdom . |
| 1429143 | 3/1976 | United Kingdom . |
| 1455873 | 11/1976 | United Kingdom . |

*Primary Examiner*—A. Lionel Clingman
*Assistant Examiner*—Hoa Van Le
*Attorney, Agent, or Firm*—Milton L. Honig; James J. Farrell

[57] ABSTRACT

Washing powders containing an aluminosilicate as a builder or part thereof are made by a process in which a slurry containing anionic surfactant, nonionic surfactant and sodium silicate is spray-dried and is formed into granules with aluminosilicate, optionally with another detergency builder, using a liquid binder.

2 Claims, No Drawings

PROCESS FOR THE MANUFACTURE OF DETERGENT COMPOSITIONS CONTAINING SODIUM ALUMINOSILICATE

This is a continuation of application Ser. No. 358,989, filed Mar. 17, 1982, now abandoned.

This invention relates to a process for making washing powders. It is particularly concerned with a process for making washing powders which contain synthetic aluminosilicates together with sequestrant builders.

Washing powders containing synthetic aluminosilicates and sequestrant builders are not new. They have been proposed as possible solutions to the environmental problems said to be caused by phosphate based powders. For example German Patent Application No. 2,539,110 discloses a washing powder containing an aluminosilicate and sodium nitrilotriacetate, together with soap and a polyacrylic acid salt. While such powders may provide satisfactory washing performance once they are in solution, they can exhibit poor water-solubility/dispersibility and the absence of large quantities of a hydratable phosphate salt can result in poor powder properties.

We have now discovered how to make washing powders containing synthetic aluminosilicates and sequestrants having satisfactory solubility/dispersion properties which are crisp and free-flowing.

Accordingly, the present invention provides a process for manufacturing washing powder comprising a synthetic aluminosilicate as a detergency builder, or part of the builder, which comprises the steps of (a) spray-drying a slurry comprising (i) an anionic detergent active compound and (ii) sodium silicate to form a spray-dried powder;

(b) binding the spray-dried powder and a detergency builder compound at least partly comprising a synthetic aluminosilicate with a liquid binder to form granules or agglomerates; and (c) drying the granules or agglomerates.

British Patent No. 1,455,873 relates to washing powder compositions intended to have a softening effect in the wash. The agent chosen to produce this effect is a naturally occurring smectite-type clay, and the powder is prepared in effect by one of a number of processes, each of which appear to rely on the fact that these clays contain natural binders. The synthetic aluminosilicates of our invention, in contrast, do not contain binders.

The synthetic aluminosilicates of this invention are. cationic exchange materials such as are described in British Patent Application No. 1,429,143 or in Netherlands Patent Application No. 7 403 381. Preferred materials of this type have the formula $$(Na_2O)_{0.7\text{-}1.1}Al_2O_3(SiO_2)_{1.3\text{-}3.3}$$

and may be amorphous or crystalline with some bound water usually in an amount of about 10–30% by weight depending on the drying conditions used. Such synthetic aluminosilicates should of course be very finely divided so as to minimise deposition on the fabrics during washing.

Whilst stages (a),(b) and (c) will in many cases suffice for the production of a washing powder, especially where the powder is intended for cold water washing, it is preferred that a fourth stage, stage (d) should be present in the process in which other components such as oxygen bleaches e.g. sodium perborate or sodium percarbonate, enzymes, perfumes and, if desired, reactive amides such as tetraacetylethylenediamine are combined with the product of stages (a),(b) and (c). Nevertheless some of these other components may also be added in stage (b) of the process.

The builder referred to in step (b) of the process defined above can be any sequestrant builder known to those skilled in the art, but part of it at least is synthetic aluminosilicate.

Other detergency builders which may be used are (i) sodium tripolyphosphate, (ii) sodium nitrilotriacetate or (iii) sodium carboxymethyloxysuccinate.

The process of the invention is applicable to fabric washing compositions containing anionic or nonionic surfactants. Examples of suitable synthetic anionic surfactants are the $C_8$–$C_{24}$ primary and secondary alkyl. sulphates, the $C_8$–$C_{24}$ secondary alkane sulphonates, and $C_8$–$C_{24}$ olefin sulphonates. $C_{10}$–$C_{22}$ sodium soaps derived from naturally-occurring oils and fats may also be used. Examples of nonionic surfactants which can be used are the $C_{10}$–$C_{24}$ primary and secondary alcohols ethoxylated with from 5 to 25 moles of ethylene oxide per mole of alcohol.

While the powders prepared by the process of the invention can be formulated with synthetic anionic surfactants alone, with soaps alone, with nonionic surfactants alone or with a binary mixture of anionic and nonionic surfactants, the process is of particular applicability to powders formulated with a so-called ternary mixture of synthetic anionic surfactant, nonionic surfactant and soap.

Typical amounts of surfactant present in the powders are from 5 to 35% by weight when a synthetic anionic surfactant or a soap is present alone; from 2 to 25% of anionic surfactant and from 0.5 to 10% by weight of nonionic surfactant when a binary mixture is used; and from 2 to 15% by weight of synthetic anionic surfactant, from 0.5 to 7.5% by weight of nonionic surfactant and from 1 to 7.5% by weight of soap when a ternary mixture is used.

The powders made by the process of the invention contain sodium silicate partly as a corrosion inhibitor and in order to produce the required alkalinity for effective detergency and partly as a structurant. Typical amounts of sodium silicate which are appropriate are from 1 to 15% by weight of the finished powder.

Other conventional components can be present in the powders in conventional amounts. Examples of these include lather controllers, anti-redeposition agents, chlorine-releasing bleaching agents, fabric softening agents, antiashing aids, slurry stabilisers, fluorescent agents, perfumes, germicides and colourants.

The invention is further described and illustrated in the following example.

Example

In a series of experiments slurries containing anionic surfactant, sodium sulphate and sodium silicate as the major components were spray-dried to powders.

Each powder was then either granulated with a synthetic aluminosilicate alone, or with a mixture of a synthetic aluminosilicate with (a) sodium nitrilotriacetate (b) sodium tripolyphosphate, or (c) sodium carboxymethyloxysuccinate and liquid binder. Preferably the liquid binder comprises an aqueous solution of sodium silicate, or comprises a nonionic surfactant.

In all the experiments the spray-dried powder was premixed in a Lödige mixer (registered trade mark) with solid components with which it was to be granulated. The mixture was transferred, using a vibrating screw feeder, to a Schugi Flexomix granulator (registered trade mark) in which it was sprayed with the liquid binder from twin phase, flat spray nozzles. The feed rate of solids was from 70–150Kg/hour, and the blades of the Flexomix were set at an angle of +2° and rotated at a frequency of 50 Hz.

The granules discharged from the mixer were then dried in a fluidised bed of the plug flow type at ambient temperature.

An optional fourth step of the process is to add other components to the granulated powders. Examples of such components are perborate salts and enzyme particles, which are added in a conventional manner.

Details of the formulations of the washing powders produced are shown in Table 1.

TABLE 1

| | A | B | C | D | E | F |
|---|---|---|---|---|---|---|
| Spray-dried component | | | | | | |
| Alkyl benzene sulphonate | 6.5 | 6.5 | 6.5 | 6.5 | 6.5 | 6.5 |
| Nonionic surfactant | — | — | — | — | 3.0 | 3.0 |
| Sodium soap ($C_{10-22}$ fatty acid) | 5.0 | 5.0 | 5.0 | 5.0 | 5.0 | 5.0 |
| Sodium sulphate | 3.5 | 5.0 | 4.5 | 6.0 | 3.5 | 5.5 |
| Synthetic aluminosilicate* | 6.0 | — | 5.0 | 4.0 | 40.0 | 30.0 |
| Sodium silicate (alkaline) | 3.0 | 5.0 | 3.0 | 2.5 | 6.0 | 6.0 |
| Sodium nitrilotriacetate | — | — | — | — | — | 10.0 |
| Water & minor components | 1.4 | 2.2 | 1.6 | 2.0 | 11.0 | 9.0 |
| Solid granulation component | | | | | | |
| Synthetic aluminosilicate* | 34.0 | 26.6 | 25.0 | 17.0 | — | — |
| Sodium nitrilotriacetate | — | — | 10.0 | — | — | — |
| Sodium carboxymethyloxy-succinate | — | 18.0 | — | — | — | — |
| Sodium tripolyphosphate | — | — | — | 18.0 | — | — |
| Sodium carboxymethyl-cellulose | 1.2 | — | 0.6 | 0.6 | — | — |
| Liquid binder | | | | | | |
| Sodium silicate | 3.0 | 3.0 | — | 3.8 | — | — |
| Nonionic surfactant | 3.0 | 3.0 | 3.0 | 3.0 | — | — |
| Water | 13.5 | 12.0 | 10.0 | 9.6 | — | — |
| Heat sensitive components | | | | | | |
| Sodium perborate | 24.5 | 26.0 | 24.5 | 24.5 | 25.0 | 25.0 |
| Enzyme particles | 0.5 | — | 0.5 | 0.5 | — | — |

*The synthetic aluminosilicate was Zeolite A-40 manufactured by Degussa GmbH

The bulk density, dynamic flow rate and compressibility of the six powders detailed above were then determined.

The bulk density was determined by standard techniques.

The dynamic flow rate was determined by a test which essentially consists of measuring the time taken for a column of powder to flow through a conical orifice, the final diameter of which is 2.2 cm.

The compressibility was determined by placing a column of the powder in a narrow cylindrical vessel. The height of the column of powder was measured and a weight was then placed on the powder to compress it. After compression the height of the column of powder was re-measured. The compressibility is the difference between the two heights, expressed as a percentage of the original height.

Also, the undissolved solid residue remaining after 2 minutes on a screen of 50μ mesh when the powder was dissolved in water at 20° C. was determined. The results are shown in Table 2.

TABLE 2

| | Solid Residue % | Bulk Density ($Kg/m^3$) | Dynamic Flow Rate (ml/sec) | Compressibility (%) |
|---|---|---|---|---|
| Powders in accordance with the invention | | | | |
| A | 7.5 | 480 | 122 | 21 |
| B | 7.8 | 518 | 127 | 20 |
| C | 11 | 480 | 108 | 14 |
| D | 14 | 525 | 108 | 13 |
| Control Powders | | | | |
| E | 45 | 400 | 80 | 28 |
| F | 34 | 430 | 80 | 21 |

It can be seen from this table that the amount of undissolved solids retained on the screen in the case of the powders in accordance with the invention is substantially lower than that remaining in the case of the control powders. Furthermore the dynamic flow rate figures for the powders of the invention are substantially higher and the compressibility figures lower than the control powders, showing that a much crisper and more free-flowing powder is produced.

What we claim is:

1. A process for manufacturing washing powder comprising a synthetic aluminosilicate as a detergency builder, said process comprising the sequence of steps of:

(a) spray-drying a slurry comprising (i) a detergent active material selected from the group consisting of anionic surfactants, nonionic surfactants, a binary mixture of anionic and nonionic surfactants and a ternary mixture of an anionic surfactant, a nonionic surfactant and a soap and (ii) sodium silicate, to form a spray-dried powder;

(b) granulating the spray-dried powder obtained in step (a) with a liquid binder and a detergency builder comprising a synthetic aluminosilicate to form granules in an apparatus separate from the apparatus in which spray-drying step (a) takes place; and (c) drying the granules obtained in step (b).

2. A process for manufacturing washing powder comprising a synthetic aluminosilicate as a detergency builder, said process comprising the sequence of steps of:

(a) spray-drying a slurry comprising (i) a detergent active material selected from the group consisting of anionic surfactants, nonionic surfactants, a binary mixture of anionic and nonionic surfactants and a ternary mixture of an anionic surfactnt, a nonionic surfactant and a soap and (ii) sodium silicate to form a spray-dried powder;

(b) granulating the spray-dried powder obtained in step (a) with a liquid binder and a detergency builder comprising a synthetic aluminosilicate to form granules, outside of a spray-drying tower; and (c) drying the granules obtained in step (b).

* * * * *